US011560861B2

(12) United States Patent
Moine

(10) Patent No.: US 11,560,861 B2
(45) Date of Patent: Jan. 24, 2023

(54) METHOD AND SYSTEM FOR CONTROLLING THE SPEED OF AN INTERNAL COMBUSTION ENGINE DRIVING A DISENGAGEABLE DEVICE

(71) Applicant: VITESCO TECHNOLOGIES GMBH, Hanover (DE)

(72) Inventor: Xavier Moine, Toulouse (FR)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 17/287,231

(22) PCT Filed: Oct. 22, 2019

(86) PCT No.: PCT/EP2019/078628
§ 371 (c)(1),
(2) Date: Apr. 21, 2021

(87) PCT Pub. No.: WO2020/083858
PCT Pub. Date: Apr. 30, 2020

(65) Prior Publication Data

US 2021/0381454 A1 Dec. 9, 2021

(30) Foreign Application Priority Data

Oct. 22, 2018 (FR) ..... 1859740

(51) Int. Cl.
*F02D 41/02* (2006.01)

(52) U.S. Cl.
CPC ..... *F02D 41/022* (2013.01); *F02D 2200/101* (2013.01); *F02D 2200/1004* (2013.01); *F02D 2200/1006* (2013.01)

(58) Field of Classification Search
CPC ..... F02D 2200/1004; F02D 2200/1006; F02D 2200/101; F02D 2400/06; F02D 41/022; F02D 41/1497
See application file for complete search history.

(56) References Cited

U.S. PATENT DOCUMENTS 4,016,709 A * 4/1977 Hauser ..... A01D 34/6806 56/10.2 R
6,500,093 B2 * 12/2002 Genise ..... B60W 10/06 477/109

(Continued)

FOREIGN PATENT DOCUMENTS

CN 1975192 A 6/2007
CN 101084368 A 12/2007

(Continued)

OTHER PUBLICATIONS

International Search Report for PCT/EP2019/078628 dated Dec. 17, 2019, 7 pages.

(Continued)

*Primary Examiner* — Carl C Staubach
(74) *Attorney, Agent, or Firm* — Nixon & Vanderhye

(57) ABSTRACT

Disclosed is a method for regulating the speed of an engine which drives a disengageable device. The regulation of the engine speed is effected in accordance with a first mode when the disengageable device is disengaged and in accordance with a second mode when the disengageable device is engaged. The determination is effected by: —estimating the resistive torque exerted on the engine by the disengageable device; -changing a binary value from a first value representative of the disengaged state to a second value representative of the engaged state when the estimated resistive torque is higher than a first predetermined threshold for a first predetermined period of time; and —changing the binary value from the second value to its first value when, (Continued)

for a second predetermined period of time, the estimated resistive torque is lower than a second threshold possibly equal to the first threshold.

21 Claims, 2 Drawing Sheets

(56) References Cited

U.S. PATENT DOCUMENTS

| | | | | |
|---|---|---|---|---|
| 6,557,687 | B1 * | 5/2003 | Herchick | F16D 25/0638 192/103 F |
| 7,025,708 | B2 | 4/2006 | Rieger et al. | |
| 7,077,785 | B2 | 7/2006 | Tanaka | |
| 7,169,082 | B2 | 1/2007 | Rieger et al. | |
| 7,640,097 | B2 | 12/2009 | Boutonnet et al. | |
| 2002/0117339 | A1 | 8/2002 | Nakashima | |
| 2005/0020407 | A1 * | 1/2005 | Tanaka | F16D 48/06 477/166 |
| 2005/0130799 | A1 * | 6/2005 | Asano | B60W 10/06 477/166 |
| 2010/0228450 | A1 * | 9/2010 | Takahashi | F16H 61/143 701/51 |
| 2015/0066309 | A1 | 3/2015 | Porter et al. | |
| 2016/0168825 | A1 * | 6/2016 | Velamakanni | F02D 31/007 701/50 |
| 2018/0178798 | A1 | 6/2018 | Peterson et al. | |
| 2020/0173381 | A1 * | 6/2020 | Lee | F02D 41/042 |

FOREIGN PATENT DOCUMENTS

| | | |
|---|---|---|
| CN | 103364140 A | 10/2013 |
| CN | 105121247 A | 12/2015 |
| EP | 1 382 876 | 1/2004 |
| JP | H08-200084 | 8/1996 |
| JP | 2014-189063 | 10/2014 |

OTHER PUBLICATIONS

Written Opinion of the ISA for PCT/EP2019/078628 dated Dec. 17, 2019, 7 pages.

Office Action in Chinese Patent Application No. 201980069519.6 dated Sep. 14, 2022.

* cited by examiner

METHOD AND SYSTEM FOR CONTROLLING THE SPEED OF AN INTERNAL COMBUSTION ENGINE DRIVING A DISENGAGEABLE DEVICE

CROSS-REFERENCE TO RELATED APPLICATIONS

This application is the U.S. national phase of International Application No. PCT/EP2019/078628 filed Oct. 22, 2019 which designated the U.S. and claims priority to FR 1859740 filed Oct. 22, 2018, the entire contents of each of which are hereby incorporated by reference.

BACKGROUND OF THE INVENTION

Field of the Invention

The present invention relates to a method and to a system for regulating the speed of an internal combustion engine which drives a disengageable device, for example but not exclusively a lawnmower engine.

The field of the invention is thus that of engine control, and more particularly for engines which are intended to drive a device with variable inertia. Said device is, for example, a lawnmower, possibly a ride-on lawnmower, having a disengageable blade. Specifically, the inertia of the lawnmower varies substantially when the blade is engaged (and driven by the engine), especially while mowing, and when the blade is disengaged.

Description of the Related Art

In the field of lawnmowers, the engine is controlled by tending to maintain a constant speed (rotational speed of the engine). However, most often the engine is controlled without taking account of the overall inertia of the entirety of the device driven by the engine. A compromise is thus obtained with a substantially constant speed for a given inertia but with variations in speed when the inertia changes.

It is also known to provide the control system with an input which indicates, for a lawnmower, whether the blade is driven (or engaged) or not. This solution allows better management of the engine speed at the moment at which the blade of the lawnmower is engaged or disengaged. However, it requires the provision of additional connections in the engine and thus incurs an additional cost in terms of equipment.

SUMMARY OF THE INVENTION

The aim of the present invention is thus to provide a method and a corresponding system for regulating the speed of an internal combustion engine that allows good control of the engine speed without, however, requiring the use of an additional sensor (or other equipment).

Another aim of the present invention is to determine the overall inertia of the device having to be driven by the engine. Therefore, it will become possible to further improve the regulation of the engine speed.

The aim of the present invention is to be able to be applied to various kinds of engine regulation, both for engines of the two-stroke type and for engines of the four-stroke type, and also regardless of the fuel used.

For this purpose, the present invention proposes a method for regulating the speed of an internal combustion engine which drives a disengageable device, in which method said regulation of the engine speed is effected in accordance with a first mode when the disengageable device is not driven by the engine (disengaged state) and in accordance with a second mode when the disengageable device is driven by the engine (engaged state).

According to the present invention, the determination of the fact that the disengageable device is driven or is not driven by the engine is effected by implementing the following steps:

- estimating the resistive torque exerted on the engine by the disengageable device,
- changing a binary value representative of the engaged or disengaged state of the disengageable device from a first value representative of the disengaged state to a second value representative of the engaged state when the estimated resistive torque is higher than a first predetermined threshold for a first predetermined period of time, and
- changing said binary value representative of the engaged or disengaged state of the disengageable device from the second value representative of the engaged state to its first value representative of the disengaged state when, for a second predetermined period of time, the estimated resistive torque is lower than a second threshold possibly equal to the first threshold, the binary value representative of the engaged or disengaged state of the disengageable device being provided to the electronic management system of the engine.

It is thus possible, by analyzing the resistive torque, to detect if the disengageable device is driven by the engine or not. This analysis can be performed via sensors which are usually present on an engine or on the basis of known parameters of a regulation and/or management system of the engine. The resistive torque can be determined for example by knowing, on the one hand, the quantities of fuel and oxidant supplied to the combustion chamber(s) of the engine and, on the other hand, the engine speed (or rotational speed). Therefore, there is no need here to provide a sensor at the clutch device for determining if said clutch device is an engaged or disengaged position.

According to a preferred variant of the method proposed above, during the change of the binary value representative of the engaged or disengaged state of the disengageable device from the second value representative of the engaged state to its first value representative of the disengaged state, the second threshold can be a threshold the value of which is determined as a function of the engine speed. In this way, the detection of the state of the clutch is more reliable.

For an even more reliable detection of the state of the clutch, in an advantageous variant embodiment it is proposed that the change of the binary value representative of the engaged or disengaged state of the disengageable device from the second value representative of the engaged state to its first value representative of the disengaged state is carried out when it is simultaneously the case that, for a second predetermined period of time:

i) the estimated resistive torque is lower than the second threshold, and ii) the variation in the engine speed per unit time is higher than a predefined acceleration threshold.

In a regulation method as described above, provision can be made that the resistive torque exerted on the engine by the disengageable device is estimated from the torque produced by the combustion inside the engine, from which torque is removed, on the one hand, the torque associated with the internal friction in the engine and, on the other hand, the acceleration torque which corresponds to $$J\frac{d\omega}{dt}$$

in which J corresponds to the moment of inertia of the device which is driven by the engine and $$\frac{d\omega}{dt}$$

corresponds to the variation in the engine speed over time.

Other calculations can of course be carried out to determine this resistive torque.

In a regulation method as described above, the resistive torque exerted on the engine by the disengageable device is used as a quantity. This resistive torque is dependent on the moment of inertia of this disengageable device. For a better estimation of the resistive torque, it is therefore advantageous to know this moment of inertia. The latter can vary over the course of the service life of the disengageable device as a function for example of its wear, but also when the disengageable device is changed. It is thus proposed that, when the system is in the engaged state, the regulation method furthermore comprises the following steps:

when the estimated resistive torque of the disengageable device on the engine is stable for a predetermined period of time, determining the moment at which the rotational speed of the engine passes a low speed threshold, storing a first value representative of the estimated resistive torque, determining the moment at which the rotational speed of the engine passes a high speed threshold, determining a moment of inertia from the estimated resistive torque, from the variation in speed, and from the measured time interval to obtain said variation in speed, and adapting a stored value representative of the moment of inertia of the disengageable device if the difference between the value determined in the preceding step and a value already stored is outside a predetermined interval.

In this method which implements an adaptation of the moment of inertia of the disengageable device, the resistive torque exerted on the engine by the disengageable device can be estimated from the torque produced by the combustion inside the engine, from which torque is removed, on the one hand, the torque associated with the internal friction of the engine and, on the other hand, the acceleration torque which corresponds to $$J\frac{d\omega}{dt}$$

in which J corresponds to the inertia of the device which is driven by the engine and $$\frac{d\omega}{dt}$$

corresponds to the variation in the engine speed over time, and in this case, a stored value representative of the moment of inertia of the disengageable device is then advantageously adapted by ignoring the variation in the internal friction of the engine.

The present invention also relates to:

A) a computer program product, comprising a series of code instructions for implementing a method for regulating the speed of an internal combustion engine which drives a disengageable device as described above, when said method is implemented by a computer;

B) a device for regulating the speed of an internal combustion engine which drives a disengageable device, comprising:

means for determining the engine speed, regulation means which make it possible to modify the engine speed, an electronic computer configured for:

changing a binary value representative of the engaged or disengaged state of the disengageable device from a first value representative of the disengaged state to a second value representative of the engaged state when the estimated resistive torque is higher than a first predetermined threshold for a first predetermined period of time, and changing said binary value representative of the engaged or disengaged state of the disengageable device from the second value representative of the engaged state to its first value representative of the disengaged state when, for a second predetermined period of time, the estimated resistive torque is lower than a second threshold possibly equal to the first threshold, and providing the binary value representative of the engaged or disengaged state of the disengageable device to an electronic management system of the engine;

C) an internal combustion engine of two-stroke type or else four-stroke type, characterized in that it comprises a power supply management device as above, and D) a lawnmower comprising an engine and a disengageable cutting blade, characterized in that the engine is an engine as above.

BRIEF DESCRIPTION OF THE DRAWINGS

Details and advantages of the present invention will become more clearly apparent from the description that follows, given with reference to the appended schematic drawing in which.

DESCRIPTION OF THE PREFERRED EMBODIMENTS

The description which will be given here makes reference to a lawnmower. Such a lawnmower conventionally comprises a structure mounted on wheels and having a mowing blade which is driven by an engine, said engine also being used for moving the lawnmower. It is assumed here that the mowing blade is connected to the engine by a clutch, for example an electromagnetic clutch. The engine is a combustion engine, which can be of the two-stroke type or the four-stroke type.

This is an exemplary embodiment for which the present invention is particularly well suited. However, the present invention can also be applied to other exemplary embodiments in which an internal combustion engine is intended to drive a device, such as a tool, by way of a clutch. This could be, for example, an engine which drives a compressor.

In a lawnmower, the engine is usually regulated to have a constant speed, which then makes it possible to have a constant rotational speed of the mowing blade. Using a control device (lever or knob, for example), the user therefore provides a setpoint corresponding to a rotational speed of the mowing blade. The power supply to the engine then varies as a function of the load applied to the engine. This load varies substantially when the mowing blade is engaged or disengaged. The regulation of the engine is adapted and one regulation mode is provided when the mowing blade is engaged and another regulation mode is provided when the mowing blade is disengaged (and thus not driven by the engine). The regulation is effected within an electronic unit, referred to below as ECU (Engine Control Unit). This ECU comprises, for example, a binary input, i.e. is able to accept two input values, generally 0 and 1. Depending on the input value, the ECU will regulate the engine in accordance with a first mode corresponding, for example, to the disengaged state of the lawnmower or else in accordance with a second mode corresponding, in this example, to the engaged state of the lawnmower. The method described below makes it possible to determine the binary value to be applied to said input of the ECU in order to adapt the regulation mode of the engine.

In another application, such as for example the driving of a compressor mentioned above, the engine will be regulated in a manner suited to this application. There will then be a regulation mode when the compressor is driven and a regulation mode corresponding to a slowed-down mode when the compressor is not driven.

The (binary) input value representative of the engaged or disengaged state of the mowing blade is referred to below as BIN. BIN can then take either the value 0 or the value 1. The value 0 corresponds to the disengaged state of the mowing blade, whereas the value 1 corresponds to the engaged state of the mowing blade.

Figure 1:
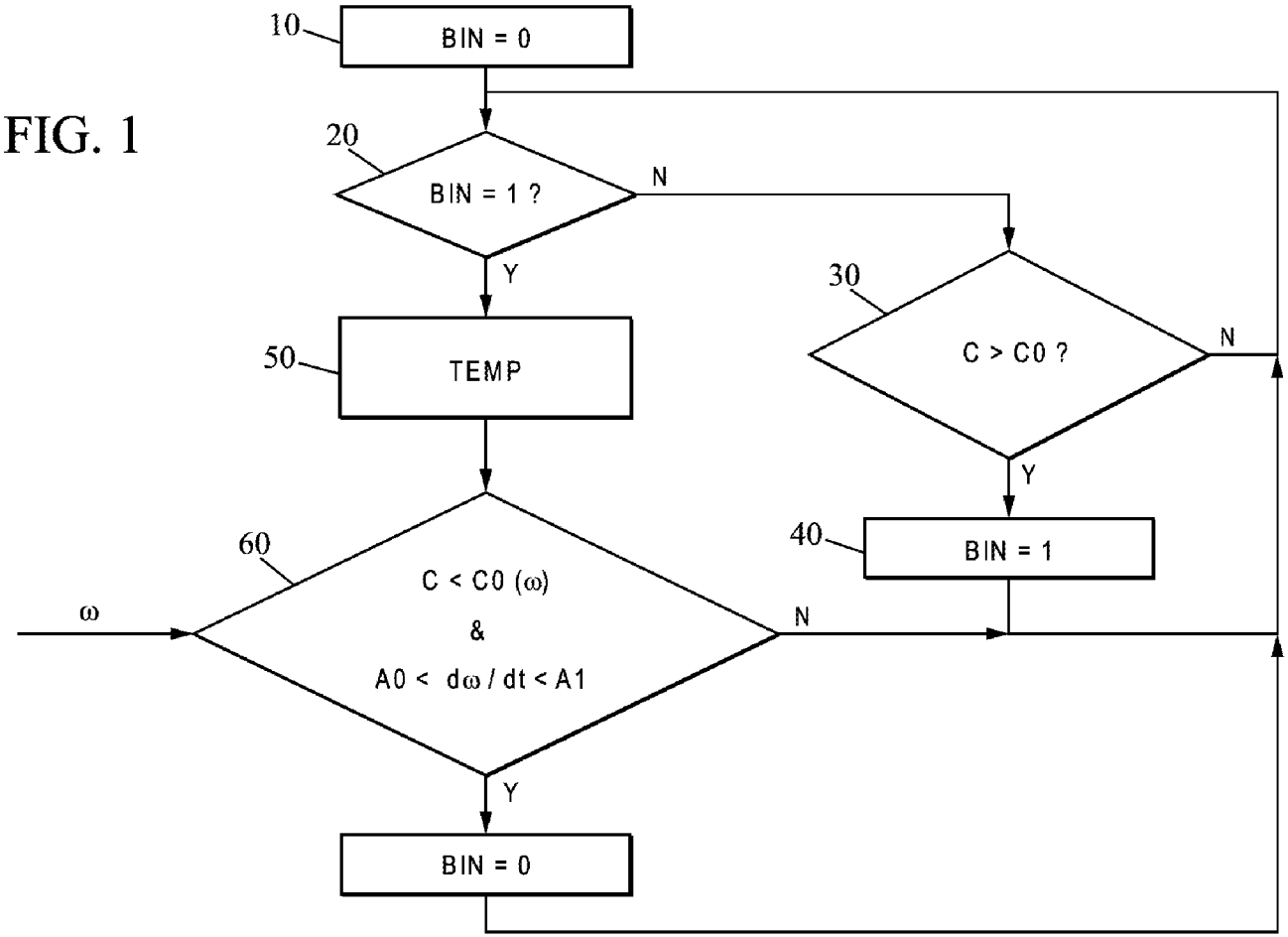
FIG. 1 is a flowchart illustrating a method for detecting if a lawnmower blade is coupled to an engine or not.

In FIG. 1, a first step 10 corresponds to an initialization of the ECU, for example to the start-up of the engine. Over the course of this initialization, BIN is set to 0. It is therefore considered that the engine is started up while the clutch is in the disengaged state, the blade then not being driven.

A second step 20 makes provision for the control of the BIN value. Here, provision is made to compare this value BIN to 1. Throughout the drawing, the letter Y on its own corresponds to "yes", whereas the letter N on its own corresponds to "no".

If, during the control of the second step 20, BIN is 0, i.e. BIN≠1 and thus the response is "no", the resistive torque exerted on the engine by the mowing blade is estimated.

The resistive torque corresponding to the load exerted on the engine by the blade is referred to as C. This torque C is substantially 0 when the blade is disengaged. When the mowing blade is engaged, this torque varies in particular depending on the "obstacles" (in particular grasses) encountered by the mowing blade in action.

The engine, for its part, produces a total torque, referred to as CT, which is produced by the fuel combustion in the engine.

The engine comprises moving mechanical parts. In fact, in order to make these parts move, a force must be exerted. The engine then has to produce a torque CF to produce this force which makes it possible to overcome the various frictions internal to the engine.

Finally, if the rotational speed of the engine and/or of the mowing blade varies (increases), a torque CA must be available to allow the engine to accelerate.

In a first approximation, the torque CT produced by the engine is thus used to drive the mowing blade, to overcome the internal friction of the engine and, more broadly, of the mowing system and to vary the rotational speed.

The following equation then applies:

$$C=CT-CF-CA$$

CT is known by the ECU since this value corresponds to the torque setpoint of the engine and is a function of the supply of fuel and oxidant (air) to the engine and also of the speed ω of the engine (in $rad \cdot s^{-1}$ or in $rev \cdot min^{-1}$).

CF can be determined in a number of ways. In a first approximation, it is a constant. CF can thus be determined more precisely as a function of the engine speed, for example by a function of the type:

$$CF(\omega)=a\omega^2+b$$

Other functions can of course be used here.

CA, for its part, depends essentially on the variation in the rotational speed of the mowing blade. The following applies:

$$CA=JT\ d\omega/dt$$

where JT is the total moment of inertia of the moving system.

The following applies: JT=J+JM where J is the moment of inertia of the mowing blade and JM is the moment of inertia of the moving parts in the engine. JM remains substantially constant—and known—and the engine parts do not change. The variation in JT then corresponds to the variation in J.

In the course of a third step 30, the resistive torque C is then determined for example as indicated above (or by any other appropriate method). A number of successive determinations are carried out over a predetermined time interval of the order, for example, of a few milliseconds (ms), for example between 1 and 20 ms. If the one or the other of these determinations leads to an estimation of the torque C that is lower than a predetermined threshold C0, it is then estimated that the mowing blade is not engaged and the BIN value is kept at 0. The method then returns to the second step 20.

By contrast, if all the determinations performed over the time interval lead to an estimation of the resistive torque C that is higher than the threshold C0, the value BIN then takes the value 1 (step 40). The method then returns to the second step 20.

If it is determined that the mowing blade is engaged, i.e. that BIN is 1, a time delay step 50 is then provided in this second step 20. Specifically, just after having detected the coupling of the mowing blade, provision is made to wait a little before initiating a detection of disengagement of the mowing blade. This time delay is, for example, of the order of one second (1 s), for example between 0.1 s and 5 s.

At the end of this time delay step, the resistive torque C exerted on the engine by the mowing blade is estimated again. By analogy with what is done in the third step 30, provision can be made to detect a disengagement when, for a predetermined period of time, the estimated resistive torque remains lower than a threshold, which can be the same threshold as that used above or else a different threshold (hysteresis effect).

However, what is proposed here, in one preferred embodiment, is another strategy for returning BIN to 0 in order to limit as far as possible the change of the value BIN to 0 while the mowing blade is still engaged.

First of all, provision is made that the threshold used here is a threshold which is variable as a function of the rotational speed of the engine (engine speed). This second threshold, which is variable, is thus denoted C0 (ω). Other parameters can be used as an alternative or in addition to the engine speed, such as for example the temperature of the engine, the position of an air intake throttle valve, etc.

Subsequently, to make the detection of a disengagement even more reliable, provision is made also to detect an increase in the engine speed.

Specifically, if the detection of a disengagement of the blade is based only on one torque measurement, a weak resistive torque could be measured when the user commands a decrease in the engine speed, although the mowing blade is still engaged. A detection of disengagement could also be triggered in the case in which the inertia of the blade is poorly known (for example after changing the blade).

In the preferred embodiment illustrated in FIG. 1, a step 60 then makes provision for cumulatively verifying that the resistive torque is below a predetermined threshold depending on the engine speed and that the increase in the engine speed is between two predefined accelerations.

FIG. 1 thus makes provision, in step 60, to check that, for a predetermined time interval, of the order of a second (for example between 0.1 and 5 s), the following apply at the same time:

$$C<C0(\omega)$$

AND $$A0<d\omega/dt<A1$$

where A0 and A1 are predetermined positive limit accelerations (in rad·s$^{-2}$ or in rev·min$^{-2}$).

If these two conditions are met, the value BIN is then returned to 0. If not, it remains at 1 and the method returns to the second step 20.

The method described above thus indicates the conditions in which provision is made to change the binary value BIN from 0 to 1 or else from 1 to 0. The tests carried out show that this method is reliable and that the value BIN is indeed at 0 when the clutch of the lawnmower is disengaged and at 1 when the clutch of the lawnmower is engaged.

In this method, the moment of inertia of the mowing blade is used to determine the resistive torque exerted on the engine by this blade. This moment of inertia can be stored in the ECU by the manufacturer when the system is being programmed. However, this moment of inertia can vary. Specifically, in the context of a sharpening operation, after a shock (bump) or the like, this moment of inertia can be modified "naturally". The blade can also be changed for a blade which is similar . . . or different. In these different scenarios, the moment of inertia of the mowing blade can change and thus influence the torque estimations made above.

Figure 2:
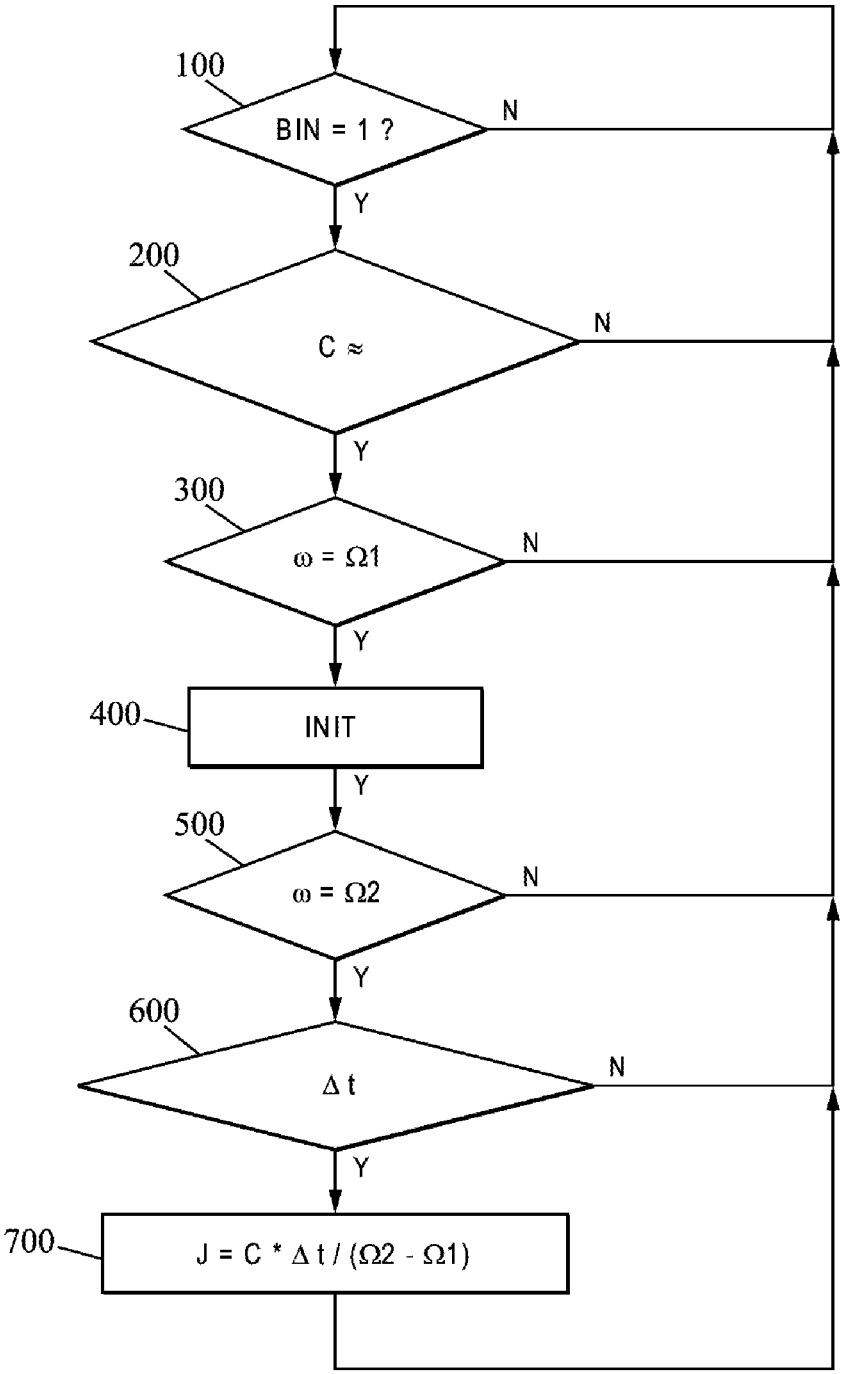
FIG. 2 is a flowchart illustrating a method for determining the moment of inertia of the lawnmower blade.

FIG. 2 proposes a method that makes it possible to adjust the value of the moment of inertia regularly to keep this value up-to-date. This method constitutes an optional addition to the invention which enables it to operate with greater precision.

The principle for adjusting the stored moment of inertia of the blade is described first of all in principle and then in greater detail with reference to FIG. 2, which illustrates a preferred embodiment.

When the mowing blade is engaged and it is desired to increase its rotational speed to pass from a low speed to a higher speed, the engine torque is regulated. A setpoint value for the engine torque is thus calculated. As indicated above, this setpoint value will take the moment of inertia of the mowing blade into account in the calculation of the component referred to as CA above and corresponding to the proportion of the engine torque used to allow the blade to accelerate. If the expected acceleration is obtained, the setpoint value is stable and the stored moment of inertia is thus adequate for the regulation system to operate. In the other cases, it will be necessary to modify the stored moment of inertia.

The flowchart of FIG. 2 makes it possible to keep the value of the stored moment of inertia in the system, for example within the ECU, "up-to-date".

During a step 100, a verification is carried out that the mowing blade is indeed engaged. It is thus verified here that the binary value BIN determined above is indeed 1.

In the course of a subsequent step 200, it is necessary to ensure that the resistive torque C determined, for example, as explained above with reference to FIG. 1 remains substantially constant. The value of this resistive torque C can be filtered, for example, and a verification is then carried out that, during a predetermined time interval, of the order of a second, for example 0.1 to 5 s, the value of estimated torque C does not differ from a predetermined value of the filtered torque. The limit can be a fixed limit, determined in Nm, or else it may be a percentage (no deviation greater than 10%, for example).

Once the resistive torque has stabilized, the instant at which the rotational speed ω takes a first value Ω1 is stored (step 300).

The adaptation of the value of the actual moment of inertia can then begin. An initializing step 400 is then provided, during the course of which the value of the stabilized resistive torque C, preferably the filtered value of this torque C, is stored, for example in a memory of the ECU.

A subsequent step 500 consists in storing the instant at which the rotational speed takes a second value Ω2. If this speed is not reached, it is then necessary to restart the adaptation procedure and return to the step 100.

If the rotational speed Ω2 is reached, it is proposed to move to a subsequent step 600. In the course of this, the time taken to change from the speed Ω1 to the speed Ω2 is determined. In FIG. 2 (and subsequently), this timeframe is referred to as Δt. This timeframe must be less than a limit determined as a function of the variation in speed (Ω2−Ω1). If this timeframe is too long, the adaptation procedure restarts (moving to step 100). If not, the adaptation is carried out in the final step 700.

To adapt the value of the moment of inertia of the mowing blade, it is estimated that the torque C is entirely used for the acceleration of the blade and therefore the change from the rotational speed Ω1 to the rotational speed Ω2. From the formula:

$$C=J\,d\omega/dt$$

the following is deduced:

$$J=C*\Delta t/(\Omega 2-\Omega 1)$$

If the value determined in this way is different than the stored value, with a margin of error of course, then the value of the moment of inertia of the mowing blade is adapted in the memory of the ECU.

It is thus possible to adapt the value of the moment of inertia of the blade over time and thus to have in the memory of the system a value for this moment of inertia which is always up-to-date.

As a variant, it can be envisioned to use the following formula for determining the moment of inertia of the mowing blade:

$$J=C*\Delta t/(\Omega 2-\Omega 1)+\delta$$

where δ is a constant, referred to for example as "offset". This offset is, for example, added to each determination of the moment of inertia. Said offset is preferably a positive value which thus tends to overestimate the moment of inertia of the mowing blade. The order of magnitude of this constant corresponds, for example, to the uncertainty regarding the determination of the moment of inertia. This overestimation makes it possible to avoid oscillations at the controller which carries out the determination of the moment of inertia.

The invention described above thus makes it possible to know the engaged or disengaged state of a disengageable device which is coupled to an internal combustion engine, without it being necessary to have a sensor at the clutch, for example (or elsewhere). It is thus possible to optimize the regulation of the engine speed.

In one advantageous variant embodiment, the method furthermore makes it possible to determine the moment of inertia of the disengageable device associated with the engine. This knowledge makes it possible here to detect the engaged or disengaged state of the disengageable device more reliably.

The present invention is particularly well suited for a lawnmower but can also be used in other devices in which a tool or the like is driven by an internal combustion engine.

Of course, the present invention is not limited to the preferred embodiment described above by way of nonlimiting example and to the variants mentioned but also relates to the other variants that are within the scope of a person skilled in the art.

The invention claimed is:

1. A method for regulating a rotational engine speed of an internal combustion engine that drives a disengageable device in accordance with either of a first mode as a disengaged state wherein the disengageable device is not driven by the engine and a second mode as an engaged state wherein the disengageable device is driven by the engine, the method comprising:

determining whether the engine and the disengageable device are in one of the disengaged state and the engaged state, by carrying out the sub-steps of:

determining an estimated resistive torque exerted on the engine by the disengageable device, comparing a value of the estimated resistive torque to a value of a first predetermined threshold torque, and when the value of the estimated resistive torque is higher than the value of the first predetermined threshold for a first predetermined period of time, changing a binary value from a first value representative of the disengaged state to a second value representative of the engaged state, and comparing the value of the estimated resistive torque to a value of a second predetermined threshold torque, and when the value of the estimated resistive torque is lower than the value of the second predetermined threshold for a second predetermined period of time, changing said binary value from the second value to the first value; and providing the binary value to an electronic management system of the engine.

2. The regulation method as claimed in claim 1, wherein, during a change of the binary value from the second value to the first value, the second threshold has a value that is determined as a function of the rotational engine speed.

3. The regulation method as claimed in claim 1, wherein a change of the binary value from the second value to the first value is carried out when, for the second predetermined period of time:

i) the estimated resistive torque is lower than the second threshold, and ii) a variation in the rotational engine speed per unit time is higher than a predefined acceleration threshold.

4. The regulation method as claimed in claim 1, wherein the estimated resistive torque exerted on the engine by the disengageable device is determined from a torque produced by combustion inside the engine, from which is subtracted both a torque associated with an internal friction in the engine and an acceleration torque that is calculated from $$J\frac{d\omega}{dt}$$

in which J corresponds to a moment of inertia of the disengageable device driven by the engine, and $$\frac{d\omega}{dt}$$

in which is a variation of the rotational engine speed over time.

5. A method for regulating a rotational engine speed of an internal combustion engine that drives a disengageable device in accordance with either of a first mode as a disengaged state wherein the disengageable device is not driven by the engine and a second mode as an engaged state wherein the disengageable device is driven by the engine, the method comprising:

determining whether the engine and the disengageable device are in one of the disengaged state and the engaged state, by carrying out the sub-steps of:

estimating a resistive torque exerted on the engine by the disengageable device, changing a binary value from a first value representative of the disengaged state to a second value representative of the engaged state when the estimated resistive torque is higher than a first predetermined threshold for a first predetermined period of time, and changing said binary value from the second value to the first value when, for a second predetermined period of time, the estimated resistive torque is lower than a second threshold; and providing the binary value to an electronic management system of the engine, wherein when the system is in the engaged state, the following further steps are carried out:

when the estimated resistive torque is stable for a third predetermined period of time, determining a first instant at which the rotational engine speed passes a low speed threshold;

storing a first value representative of the estimated resistive torque;

determining a second instant at which the rotational engine speed passes a high speed threshold;

determining a value of a moment of inertia from the estimated resistive torque, from a variation in the rotational engine speed, and from a measured time interval used to obtain said variation of the rotational engine speed; and when a difference between the determined value of the moment of inertia determined in the preceding step and a stored value of a moment of inertia of the disengageable device is outside a predetermined interval, modifying the stored value.

6. The regulation method as claimed in claim 5, wherein the resistive torque exerted on the engine by the disengageable device is estimated from a torque produced by the combustion inside the engine, from which is subtracted both a torque associated with an internal friction in the engine and an acceleration torque that is calculated from $$J\frac{d\omega}{dt}$$

in which J corresponds to the moment of inertia of the disengageable device driven by the engine, and $$\frac{d\omega}{dt}$$

in which is the variation of the rotational engine speed over time, and wherein the stored value of the moment of inertia of the disengageable device is modified by ignoring a variation in the internal friction of the engine.

7. A non-transitory computer-readable medium on which is stored a computer program, comprising computer instructions that, upon execution by a computer, causes the computer to implement the method for regulating the speed of an internal combustion engine as claimed in claim 1.

8. A device for regulating a speed of an internal combustion engine that drives a disengageable device, comprising:

means for determining an engine speed of the engine;

an electronic computer; and regulation means for modifying the engine speed, wherein the electronic computer is configured to:

determine an estimated resistive torque exerted on the engine by the disengageable device, compare a value of the estimated resistive torque to a value of a first predetermined threshold torque, and when the value of the estimated resistive torque is higher than the value of the first predetermined threshold for a first predetermined period of time, change a binary value from a first value representative of the disengaged state to a second value representative of the engaged state, compare the value of the estimated resistive torque to a value of a second predetermined threshold torque, and when the value of the estimated resistive torque is lower than the value of the second predetermined threshold for a second predetermined period of time, change said binary value from the second value to the first value, and provide the binary value to an electronic management system of the engine.

9. An internal combustion engine of four-stroke type, characterized in that said internal combustion engine comprises a device as claimed in claim 8.

10. A lawnmower comprising an engine of four-stroke type and a disengageable cutting blade, characterized in that the engine comprises a device as claimed in claim 8.

11. The regulation method as claimed in claim 2, wherein a change of the binary value from the second value to the first value is carried out when, for the second predetermined period of time:

i) the estimated resistive torque is lower than the second threshold, and ii) a variation in the rotational engine speed per unit time is higher than a predefined acceleration threshold.

12. The regulation method as claimed in claim 2, wherein the estimated resistive torque exerted on the engine by the disengageable device is determined from a torque produced by combustion inside the engine, from which is subtracted both a torque associated with an internal friction in the engine and an acceleration torque that is calculated from $$J\frac{d\omega}{dt}$$

in which J corresponds to a moment of inertia of the disengageable device driven by the engine, and $$\frac{d\omega}{dt}$$

in which is a variation of the rotational engine speed over time.

13. The regulation method as claimed in claim 3, wherein the estimated resistive torque exerted on the engine by the disengageable device is determined from a torque produced by combustion inside the engine, from which is subtracted both a torque associated with an internal friction in the engine and an acceleration torque that is calculated from $$J\frac{d\omega}{dt}$$

in which J corresponds to a moment of inertia of the disengageable device driven by the engine, and $$\frac{d\omega}{dt}$$

in which is a variation of the rotational engine speed over time.

14. The regulation method as claimed in claim 2, wherein when the system is in the engaged state, the following further steps are carried out:

when the estimated resistive torque is stable for a third predetermined period of time, determining a first instant at which the rotational engine speed passes a low speed threshold;

storing a first value representative of the estimated resistive torque;

determining a second instant at which the rotational engine speed passes a high speed threshold;

determining a value of a moment of inertia from the estimated resistive torque, from a variation in the rotational engine speed, and from a measured time interval used to obtain said variation of the rotational engine speed; and when a difference between the determined value of the moment of inertia determined in the preceding step and a stored value of a moment of inertia of the disengageable device is outside a predetermined interval, modifying the stored value.

15. The regulation method as claimed in claim 3, wherein when the system is in the engaged state, the following further steps are carried out:

when the estimated resistive torque is stable for a third predetermined period of time, determining a first instant at which the rotational engine speed passes a low speed threshold;

storing a first value representative of the estimated resistive torque;

determining a second instant at which the rotational engine speed passes a high speed threshold;

determining a value of a moment of inertia from the estimated resistive torque, from a variation in the rotational engine speed, and from a measured time interval used to obtain said variation of the rotational engine speed; and when a difference between the determined value of the moment of inertia determined in the preceding step and a stored value of a moment of inertia of the disengageable device is outside a predetermined interval, modifying the stored value.

16. The regulation method as claimed in claim 4, wherein when the system is in the engaged state, the following further steps are carried out:

when the estimated resistive torque is stable for a third predetermined period of time, determining a first instant at which the rotational engine speed passes a low speed threshold;

storing a first value representative of the estimated resistive torque;

determining a second instant at which the rotational engine speed passes a high speed threshold;

determining a value of a moment of inertia from the estimated resistive torque, from a variation in the rotational engine speed, and from a measured time interval used to obtain said variation of the rotational engine speed; and when a difference between the determined value of the moment of inertia determined in the preceding step and a stored value of a moment of inertia of the disengageable device is outside a predetermined interval, modifying the stored value.

17. A non-transitory computer-readable medium on which is stored a computer program, comprising computer instructions that, upon execution by a computer, causes the computer to implement the method for regulating the speed of an internal combustion engine as claimed in claim 2.

18. The regulation method as claimed in claim 1, wherein the second threshold is equal to the first threshold.

19. The device as claimed in claim 8, wherein the second threshold is equal to the first threshold.

20. The device as claimed in claim 8, wherein the electronic computer is configured to determine the estimated resistive torque exerted on the engine by the disengageable device from a torque produced by combustion inside the engine, from which is subtracted both a torque associated with an internal friction in the engine and an acceleration torque that is calculated from $$J\frac{d\omega}{dt}$$

in which J corresponds to a moment of inertia of the disengageable device driven by the engine, and $$\frac{d\omega}{dt}$$

in which is a variation of the rotational engine speed over time.

21. The device as claimed in claim 8, wherein the electronic computer is further configured to, when the system is in the engaged state:

when the estimated resistive torque is stable for a third predetermined period of time, determine a first instant at which the rotational engine speed passes a low speed threshold;

store a first value representative of the estimated resistive torque;

determine a second instant at which the rotational engine speed passes a high speed threshold;

determine a value of a moment of inertia from the estimated resistive torque, from a variation in the rotational engine speed, and from a measured time interval used to obtain said variation of the rotational engine speed; and when a difference between the determined value of the moment of inertia determined in the preceding step and a stored value of a moment of inertia of the disengageable device is outside a predetermined interval, modify the stored value.

* * * * *